United States Patent [19]

Kawaguchi

[11] Patent Number: 4,983,879

[45] Date of Patent: Jan. 8, 1991

[54] SHADOW MASK TYPE COLOR CATHODE RAY TUBE WITH SHADOW MASK EFFECTIVE TO MINIMIZE THE APPEARANCE OF MOIRE PATTERNS

[75] Inventor: Takeo Kawaguchi, Nagaokakyo, Japan

[73] Assignee: Mitsubishi Denki Kabushiki Kaisha, Kyoto, Japan

[21] Appl. No.: 284,326

[22] Filed: Dec. 14, 1988

[30] Foreign Application Priority Data

Dec. 17, 1987 [JP] Japan ..... 62-322179

[51] Int. Cl.[5] ..... H01J 29/81

[52] U.S. Cl. ..... 313/402; 313/403; 313/408

[58] Field of Search ..... 313/402, 403, 408

[56] References Cited

U.S. PATENT DOCUMENTS

| | | | |
|---|---|---|---|
| 3,590,303 | 6/1971 | Coleclough | 313/408 |
| 3,766,419 | 10/1973 | Barbik | 313/403 |
| 3,973,159 | 8/1976 | Barten | 313/403 |
| 4,210,842 | 7/1980 | Nakayama et al. | 313/403 |
| 4,326,147 | 4/1982 | Nakayama et al. | 313/403 |

FOREIGN PATENT DOCUMENTS 0194724 9/1986 European Pat. Off. .

OTHER PUBLICATIONS

Patent Abstracts of Japan, unexamined application, 57-194437, E field, vol. 7, No. 45, Feb. 23, 1938, p. 2E160.

Patent Abstracts of Japan, unexamined application, 60-243944, E field, vol. 10, No. 104, Apr. 19, 1986, p. 88E 397.

Soviet Inventions Illustrated, SU 1067-547, week 8437, Oct. 24, 1984.

Patent Abstracts of Japan, unexamined application, 55-124930, E field, vol. 4, No. 181, Dec. 13, 1980, p. 121E37.

*Primary Examiner*—Donald J. Yusko
*Assistant Examiner*—Michael Horabik

[57] ABSTRACT

A color cathode ray tube which includes an evacuated envelope having a phosphor deposited screen and an electron gun assembly positioned in opposition to the phosphor deposited screen and operable to emit electron beams towards the phosphor deposited screen, and an apertured shadow mask disposed inside the envelope in the vicinity of and generally parallel to the phosphor deposited screen and spaced a predetermined distance from the phosphor deposited screen. The pitch between each of the neighboring apertures in the shadow mask as measured in a vertical direction perpendicular to a horizontal scanning line is chosen to be a value variable as a function of the distance away from the center of the phosphor deposited screen.

14 Claims, 3 Drawing Sheets

SHADOW MASK TYPE COLOR CATHODE RAY TUBE WITH SHADOW MASK EFFECTIVE TO MINIMIZE THE APPEARANCE OF MOIRE PATTERNS

BACKGROUND OF THE INVENTION

1. Field of the Invention

The present invention generally relates to a color picture tube for displaying colored pictures and, more particularly, to a color cathode ray tube of a type having a shadow mask.

2. Description of the Prior Art

FIG. 1 of the accompanying drawings illustrates, in schematic longitudinal sectional representation, the exemplary prior art cathode ray tube of a type having a shadow mask. The color cathode ray tube shown therein comprises a highly evacuated envelope 1 including a funnel section closed at one end by a faceplate 11 and at the opposite end continued to a generally cylindrical neck section. The neck section has an electron gun assembly 2 accommodated therein for emitting three electron beams S. The faceplate 11 has an inner surface deposited with a predetermined pattern of primary color elemental phosphor deposits, for example, triads of red, blue and green phosphor dots, thereby to form a phosphor deposited screen 1*a*. An apertured shadow mask 4 is supported within the envelope 1 in a well known manner generally in parallel relationship with the phoshor deposited screen 1*a* and spaced a predetermined distance inwardly from the phosphor deposited screen 1*a*. The envelope 1 has a deflection yoke assembly 3 mounted thereon at the boundary between the neck section and the funnel section for developing a horizontal deflection magnetic field and a vertical deflection magnetic field in a well known manner.

In this construction, the three electron beams S emanating from the electron gun assembly 2 travel towards the phosphor deposited screen 1*a*. During the travel of the electron beams S towards the phosphor deposited screen 1*a*, the electron beams are deflected under the influence of the horizontal deflection magnetic field so as to scan the phosphor deposited screen 1*a* generally horizontally, that is, along the horizontal scanning lines, and also under the influence of the vertical deflection magnetic field so as to retrace the phosphor deposited screen 1*a* generally vertically. The vertical movement of the electron beams S takes place after the electron beams S have scanned the phosphor deposited screen 1*a* horizontally from top to bottom.

The electron beams S having passed through the deflection magnetic field pass through the apertures in the shadow mask 4 and then impinge upon the phosphor deposited screen 1*a*, allowing the triads of the primary elemental color phosphor dots, which are stricken by the electron beams S, to emit light. Actual image reproduction is accomplished by scanning the electron beams S across the phosphor deposited screen 1*a* while the electron beams S passing through the apertures in the shadow mask 4 successively impinge upon the triads of the primary color elemental phosphor dots.

FIG. 2 illustrates a portion of the shadow mask 4 used in the prior art cathode ray tube on an enlarged scale for the purpose of showing the details thereof. Let it be assumed that the widthwise direction of the phosphor deposited screen 1*a* parallel to the horizontal scanning lines is represented by an X-axis and the heightwise direction of the same screen 1*a* perpendicular to the widthwise direction thereof is represented by a Y-axis, with the point of origin of the X-Y coordinate system being occupied by the center of the phosphor deposited screen 1*a* that is aligned with the longitudinal axis (or Z-axis) of the envelope of the cathode ray tube. As shown, the shadow mask 4 has a plurality of vertically extending parallel rows of slots 4*a* of equal length, each of said rows extending parallel to the Y-axis direction and each of said slots 4*a* having a longitudinal axis also lying parallel to the Y-axis. When the pitch between each neighboring slots 4*a* in each row is expressed by Pv, the slots 4*a* in one of the rows and the slots 4*a* in the next adjacent row are offset vertically with respect to each other by a distance equal to half the slot pitch Pv. In other words, the slots 4*a* in the respective rows are alternately staggered relative to each other.

Since each bridge portion 4*b* of the shadow mask 4 delimited by the neighboring slots 4*a* in each row blocks the passage of the electron beams S traveling towards the phosphor deposited screen 1*a*, it is observed that, during the operation of the color cathode ray tube, rows of shadows, spaced a distance equal to half the slot pitch Pv, of the bridge portion 4*b* are cast horizontally upon the phosphor deposited screen 1*a*, thereby forming a pattern of bright and dark fringes occasioned by the bridge portions 4*b*.

On the other hand, it is well known that the number of the horizontal scanning lines is fixed at 525 lines according to the NTSC television system and 625 lines according to the PAL television system. It is also well known that the electron beams S have their own size which is smaller than the distance between the neighboring horizontal scanning lines. Accordingly, a shadow is observed between the neighboring scanning lines which forms a pattern of bright and dark fringes occasioned by the electron beams S.

Therefore, when the shadows occasioned by the bridge portions 4*b* of the shadow mask 4 and the shadow occasioned by the electron beams S interfere with each other, the result is the apperance of Moire patterns in the reproduced pictures.

In order to minimize the appearance of the Moire patterns in the pictures being reproduced on the screen of the color cathode ray tube, the slot pitch Pv is carefully selected. The selection of the slot pitch Pv for the purpose of minimizing the appearance of the Moire patterns is generally carried out by the following manner. Assuming that, as shown in FIG. 3 of the accompanying drawing which illustrates a partial cross-section of the faceplate 11 of the color cathode ray tube together with the shadow mask 4 in relation to the center of deflection indicated by 10, the distance equal to half the slot pitch Pv, which is hereinafter referred to as "half slot pitch", is expressed by Pa, that is, Pv/2=Pa; the distance between the neighboring horizontal scanning line as measured on the shadow mask 4 in the vertical direction is expressed by Ps; and the recurrent interval of the Moire patterns (hereinafter referred to as "Moire pitch") is expressed by Pm, the following relationship can be established.

$$Pm(m, n) = |(2Ps \cdot Pa)/(2mPs - nPa)| \quad (1)$$

wherein m and n represent an integer. The result of experiment has shown that, in the case (a) where m and n are 1 and 3, respectively, or the case (b) where m and n are 1 and 4, respectively, or the case (c) where m and n are 1 and 5, respectively, the Moire patterns tend to become prominent. The relationship between the normalized Moire pitch (which is represented by the recurrent interval Pm of the Moire patterns divided by the effective diameter as measured in the vertical direction) and the normalized half slot pitch (which is represented by the half slot pitch Pa divided by the effective diameter as measured in the vertical direction), which is found in the NTSC television system, is shown in FIG. 4. It is to be noted that the term "effective diameter as measured in the vertical direction" referred to above and hereinafter is intended to mean the length of that portion of the shadow mask where the slots are formed as taken in the Y-axis. In the case of the 27-inch, 110° deflection color cathode ray tube, the Moire pattern can be minimized when the normalized distance is $1.28\times10^{-3}$, in which case the slot pitch Pv gives 0.91 mm. The use of the increased number for the half slot pitch Pa in the equation (1) above is effective to increase the recurrent interval Pm and consequently to minimize the Moire patterns. However, since as is well known to those skilled in the art the shadow mask is so deformed as to assume a generally spherical shape, the slot pitch Pv is more or less smaller than 1.5 mm. When the slot pitch Pv is smaller than 1.5 mm as shown in FIG. 3, that is, when the normalized half slot pitch is smaller than $2.1\times10^{-3}$, complete removal of the appearance of the Moire patterns in the reproduced pictures is not possible. Although the appearance of the Moire patterns in the reproduced pictures can be reduced if the width B of each bridge portion 4b as indicated in FIG. 3 is reduced because the reduction in bridge width B corresponds to the use of the increased slot pitch Pv, the problem associated with manufacturing of the shadow mask necessitates the employment of the bridge width B within a predetermined range regardless of the particular value for the slot pitch Pv, particularly $0.1\ \text{mm}\leqq B\leqq 0.15$ mm. The size of the shadow cast upon the phosphor deposited screen 1a under the influence of the bridge width B tends to increase in proportion to the increase of the deflection angle and in inverse proportion to the curvature of the shadow mask 4 (or in proportion to the radius of curvature thereof).

Also, the width of each horizontal scanning line, as will be described later, tends to be lessened with improvement of the focusing of the electronic lens used in the color cathode ray tube. Particularly in the case of the color cathode ray tube wherein the sophisticated electron gun assembly is employed which is effective to permit the image to be accurately focused substantially all over the phosphor deposited screen by applying a modulated voltage synchronized with the deflection current to the focusing electrodes used in the electron gun assembly, bright and dark stripes of the scanning lines tend to be prominent all over the phosphor deposited screen and the pattern of distribution of the Moire pitches attributable to the interference thereof with the bright and dark fringes resulting from the bridge portions 4b varies from place to place on the phosphor deposited screen. Therefore, with such color cathode ray tube using the sophisticated electron gun assembly, the use of the constant slot pitch Pv tends to result in the considerable appearance of the Moire pattern.

The inventor of the present invention is aware that anyone of the U.S. Pat. No. 3,973,159, No. 4,210,842 and No. 4,326,147, issued Aug. 3, 1976, July 1, 1980, and Apr. 20, 1982, respectively, discloses a technique for suppressing the appearance of the Moire patterns in the reproduced pictures by varying the half slot pitch in the Y-axis direction in a predetermined relation. However, it has been found that none of the prior art techniques is satisfactory.

Summarizing the above, since in the prior art color cathode ray tube of the type using the apertured shadow mask, the slot pitch are uniform all over the entire surface of the shadow mask, minimization of the appearance of the Moire patterns anywhere on the phosphor deposited screen has been difficult to achieve.

SUMMARY OF THE INVENTION

Therefore, the present invention has been developed to substantially eliminate the problems inherent in the prior art color cathode ray tubes with a view to providing an improved color cathode ray tube using the apertured shadow mask, which is effective to minimize the appearance of the Moire patterns satisfactorily.

In order to accomplish the above described object, the present invention provides a color cathode ray tube of a type utilizing the apertured shadow mask wherein the pitch Pv between the neighboring apertures as taken in the vertical direction perpendicular to the horizontal scanning line is chosen to be of a value variable as a function of the distance away from the center line of the shadow mask in the X-axis direction or in the Y-axis direction.

According to the present invention, the apertures in the shadow mask are so arranged and so positioned that the pitch between the neighboring apertures in the shadow mask in the direction perpendicular to the horizontal scanning lines may vary with a value determined as a function of the distance away from the center line of the shadow mask corresponding to the X-axis or Y-axis of the phosphor deposited screen lying perpendicular to or parallel to the scanning lines, respectively. Therefore, the appearance of the Moire patterns in the reproduced pictures resulting from the interference between the bright and dark shadows corresponding to portions of the shadow mask each delimited between the neighboring apertures and the bright and dark stripes inherent in the horizontal scanning lines can be advantageously minimized or substantially eliminated.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined solely by the appended claims. In the drawings, like reference numerals denote like parts in the several views, wherein:

DETAILED DESCRIPTION OF THE EMBODIMENT

It is to be noted that the X-Y-Z coordinate system including the X-, Y- and Z-axes, which has been described as applied to the phosphor deposited screen in the foregoing description is, in the following description, equally applied to the apertured shadow mask since the apertured shadow mask is in practice oriented in the same way as the phosphor deposited screen.

Figure 1:
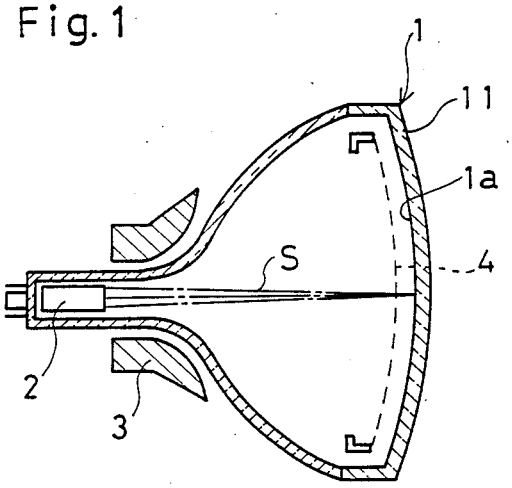
FIG. 1 is a schematic longitudinal sectional view of a color cathode ray tube of the type utilizing an apertured shadow mask.
Figure 2:
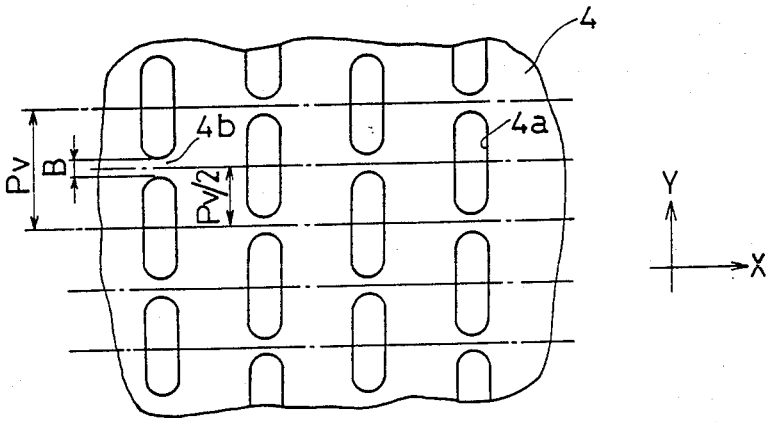
FIG. 2 is a plan view, on an enlarged scale, of a portion of the apertured shadow mask showing the arrangement of slots in the shadow mask.

In the color cathode ray tube employing the shadow mask whose apertures are in the form of slots such as discussed with reference to FIG. 2, if the slot pitch Pv is chosen to be a value effective to minimize the appearance of the Moire pattern, that is, a value enough to permit the half slot pitch Pa divided by the effective diameter to be equal to $1.28\times10^{-3}$ and if the bridge width B (See FIG. 2) is fixed at 0.13 mm, the slot pitch Pv will be 0.91 mm in the case of the 27-inch, 110° deflection color cathode ray tube, which slot pitch when projected on the phosphor deposited screen 1*a* will become 0.974 mm. On the other hand, the size of the shadow formed by each bridge portion 4*b* of the shadow mask 4 delimited between the neighboring slots 4*a* will be 0.12 mm as measured on the horizontal center line of the phosphor deposited screen 1*a* (that is, on the X-axis of the phosphor deposited screen) extending parallel to the horizontal scanning line and will be 0.21 mm at one edge portion of the phosphor deposited screen 1*a* distant from the horizontal center line, that is, the X-axis. Specifically, the slot pitch Pv increases progressively with increase of the distance away from the horizontal center line and is in proportion to the square of such distance.

Accordingly, the shade of the bridge portion projected on the phosphor deposited screen 1*a* in the vertical direction increases in size with increase of the distance away from the horizontal center line and may increase 9.3% at one edge portion of the phosphor deposited screen 1*a* as compared with that at a portion of the phosphor deposited screen 1*a* that is aligned with the horizontal center line. Since the Moire patterns result from the interference between the bright and dark fringes attributable to the bridge portions 4*b* and the bright and dark stripes attributable to the horizontal scanning lines, the difference in size of the shades of the bridge portions 4*b* projected on the phosphor deposited screen 1*a* necessarily leads to the difference in Moire pattern all over the entire surface of the phosphor deposited screen 1*a*.

Figure 3:
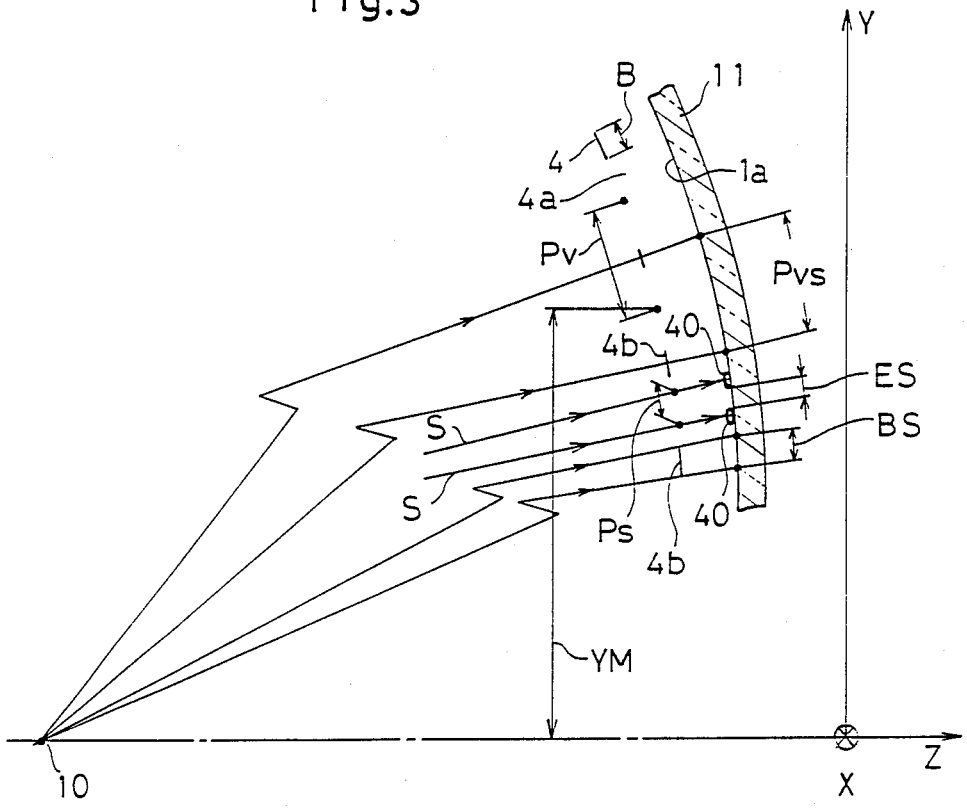
FIG. 3 is a fragmentary side sectional view of a portion of the color cathode ray tube, showing the dimensional relationship between the apertured shadow mask and the phosphor deposited screen.
Figure 4:
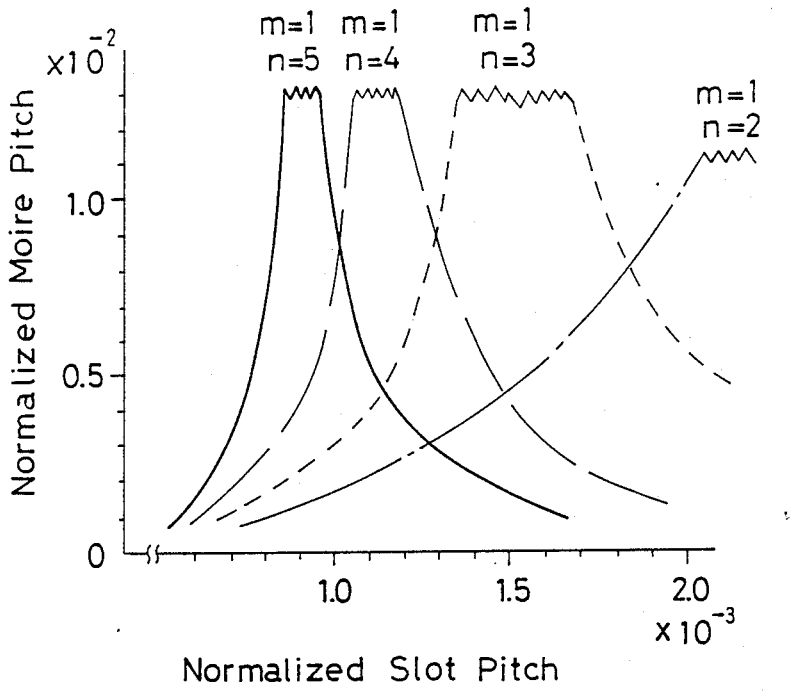
FIG. 4 is a graph showing the relationship between the normalized Moire pitch and the normalized half slot pitch.

In view of the foregoing, it is recommended to satisfy the following relationship.

$$[(Ps-Es)/Ps]\cdot[(Pvs-Bs)/Pvs]=\text{constant} \quad (2)$$

wherein, as shown in FIG. 3, Pvs represents the bridge pitch as measured between respective shadows of the neighboring bridge portions 4*b* projected on the phosphor deposited screen 1*a* from the center of deflection 10, Bs represents the size of the shadow of each bridge portion 4*b* projected on the phosphor deposited screen 1*a*, Ps represents the interval between the neighboring horizontal scanning lines on the phosphor deposited screen 1*a* as measured in the vertical direction, and Es represents the size of the shadow formed on the phosphor deposited screen 1*a* between the neighboring horizontal scanning lines, that is the interval between the neighboring beam spots 40 then sweeping the phosphor deposited screen 1*a* horizontally.

Since the difference between the interval Ps and the size Es of the shadow formed on the phosphor deposited screen 1*a* between the neighboring horizontal scanning lines, both used in the equation (2) above, correspond to the effective surface area of the phosphor deposited screen 1*a* which is rendered luminescent by the effect of the scanning lines, such difference is referred to as the width of the scanning line in the description of the present invention. Also, the difference between the bridge pitch Pvs and the size Bs of the shadow of each bridge portion 4*b*, both also used in the equation (2) above, corresponds to the effective surface area of each slot 4*a*, and the quotient of the difference between the bridge pitch Pvs and the size Bs divided by the bridge pitch Pvs in the equation (2) above represents the transmittance of the scanning line.

In order to achieve the condition represented by the equation (2) above, either the bridge width B of each bridge portion 4*b* as measured in the vertical direction or the slot pitch Pv has to be adjusted. If the slot pitch Pv is fixed, increase of the bridge width B results in increase of the proportion of the phosphor deposited screen which is occupied by the shade of the bridge portions 4*b*, accompanied by decrease in proportion of the electron beams impinging upon the phosphor deposited screen 1*a*. The consequence is that the screen brightness tends to be lowered. Therefore, it is recommended to adjust the slot pitch Pv while the bridge width B is fixed.

To choose the slot pitch Pv in accordance with the present invention for the purpose of minimizing the appearance of the Moire patterns in the reproduced pictures, two methods can be contemplated as discussed under separate headings below.

(A) Where the quotient of the difference (Ps−Es) divided by the interval Ps in the equation (2) above is constant all over the phosphor deposited screen, the quotient of the difference (Pvs−Bs) divided by the bridge pitch Pvs must be constant in order to satisfy the relationship expressed by the equation (2). This can be accomplished by increasing the interval between the neighboring bridge portions 4*b* taken in the vertical direction and, hence, the slot pitch Pv, in proportion to the increase of the size Bs of the shadow of the bridge portion 4*b* in the vertical direction. By so doing, the appearance of the Moire patterns in the pictures being reproduced on the phosphor deposited screen 1*a* of the color cathode ray tube can be effectively minimized without the screen brightness being lowered.

(B) Where the quotient of the difference (Ps−Es) divided by the interval Ps in the equation (2) above varies from the center of the phosphor deposited screen 1*a* towards one edge of the phosphor deposited screen 1*a* (or the periphery of the phosphor deposited screen 1*a*), and in order to satisfy the relationship expressed by the equation (2), the quotient, (Pvs−Bs)/Pvs, has to be of a value inversely proportional to the quotient, (Ps−Es)/Ps. In other words, the slot pitch Pv in the term of (Ps−Es)/Ps of the equation (2) above has to be varied enough to satisfy the inversely proportional relationship with the term of (Pvs−Bs)/Pvs in the equation (2) above. By so doing, the appearance of the Moire patterns in the pictures being reproduced on the phosphor deposited screen 1a can be effectively minimized without the screen brightness being lowered.

As is well known to those skilled in the art, since the horizontal scanning lines are deflected in both of horizontal and vertical directions, during the operation of the color cathode ray tube, both of the size Es of the shadow between the neighboring horizontal scanning lines and the size Bs of the shadow of each bridge portion 4b vary in both of the horizontal and vertical directions as a result of change in the focusing characteristic in respective horizontal and vertical directions. Therefore, the slot pitch Pv is preferred to be varied in both of the horizontal and vertical directions. However, as far as the method (A) described above is concerned, the increase of the slot pitch Pv in proportion to the size Bs of the shadow of the bridge portion 4b only in the vertical direction is satisfactory and effective to minimize the appearance of the Moire patterns since the size Bs of the shadow of the bridge portion does not vary in the horizontal direction so much as that in the vertical direction.

Determining the optimum slot pitch Pv satisfying the equation (2) from the measurements exhibited by a 27-inch, 110° deflection color cathode ray tube designed to minimize the appearance of the Moire patterns, it has been found that the slot pitch at a portion of the shadow mask 4 generally in alignment with the horizontal center line thereof, which slot pitch is designated Pvo, was 0.91 mm and the slot pitch at one edge portion of the shadow mask 4 corresponding to the upper or lower side of the shadow mask 4, which slot pitch is designated Pve, was 1.01 mm. Accordingly, in the practice of the present invention, the slot pitch Pv is chosen to be a varying value which satisfies the following equation, because the effective diameter divided by 2 is equal to 177.8 mm.

$$Pv=0.91+3.16\times10^{-6}\times Y_M^2 \quad (3)$$

wherein $Y_M$ represents the distance away from the horizontal center line of the shadow mask 4 in a direction parallel to the Y-axis, that is, the vertical direction perpendicular to the horizontal scanning direction. Thus, it will readily be understood that the slot pitch Pv so chosen according to the present invention varies with the increase in distance away from the horizontal center line of the apertured shadow mask 4.

It is to be noted that, although the ratio of the slot pitch at that portion of the shadow mask 4 in alignment with the horizontal center line thereof relative to the slot pitch at that edge portion of the same shadow mask, that is, Pve/Pvo, exhibited by the above discussed color cathode ray tube was 1.10(=1.01/0.91), a result of experiments has shown that the ratio within the range of 1.05 to 1.20 has been effective to minimize the appearance of the Moire patterns.

Although the present invention has fully been described in connection with the preferred embodiment thereof with reference to the accompanying drawings used only for the purpose of illustration, those skilled in the art will readily conceive numerous changes and modifications within the framework of obviousness upon the reading of the specification herein presented of the present invention. By way of example, although in the illustrated embodiment reference has been made to the color cathode ray tube of the type employing the apertured shadow mask whose apertures are in the form of slots, that is, the apertures having a sense of length, the present invention can be equally applicable to the color cathode ray tube using the apertured shadow mask whose apertures are in the form of minute circular holes.

In any event, the present invention is to be understood as applicable where the pitch between each of the neighboring apertures in the shadow mask used in any color cathode ray tube is so chosen to vary that the product of the transmittance of the scanning line in a direction perpendicular to the horizontal scanning line, which transmittance is determined by the effective surface area of the phosphor deposited screen rendered luminescent by the effect of the scanning lines through the apertures in the shadow mask, multiplied by the ratio of the width of each horizontal scanning line relative to the interval between each neighboring horizontal scanning lines assumes a generally constant value all over the phosphor deposited screen.

Accordingly, such changes and modifications are, unless they depart from the spirit and scope of the present invention as delivered from the claims annexed hereto, to be construed as included therein.

What is claimed is:

1. A color cathode ray tube comprising:

evacuated envelope means having a phosphor deposited screen and an electron gun assembly, positioned in opposition to said phosphor deposited screen, for emitting electron beams towards said phosphor deposited screen; and apertured shadow mask means disposed inside said evacuated envelope means generally parallel and in the vicinity spaced a predetermined distance from said phosphor deposited screen for partially blocking said electron beams from impinging upon said phosphor deposited screen, said apertured shadow mask means having a pattern of minute apertures with intervening bridges, the pitch between each of the neighboring apertures measured in a vertical direction perpendicular to a horizontal scanning line is variable as a function of distance away form an X-axis parallel to the horizontal scanning line including the center of said apertured shadow mask means or of distance away from a Y-axis perpendicular to said X-axis satisfying the relationship $$[(Ps-Es)/Ps]\cdot[(Pvs-Bs)/Pvs]=\text{constant}$$

wherein Pvs represents bridge pitch between respective shadows of neighboring bridges projected upon said phosphor deposited screen, Bs represents shadow size of said bridge projected upon said phosphor deposited screen, Ps represents an interval between neighboring horizontal scanning lines on said phosphor deposited screen, and Es represents shadow size formed on said phosphor deposited screen between neighboring horizontal scanning lines, to minimize the effects of Moire patterns formed on said phosphor deposited screen.

2. The cathode ray tube as claimed in claim 1, wherein said pitch varies in proportion to said bridge shadow size Bs between the neighboring apertures.

3. The cathode ray tube as claimed in claim 1, wherein the pitch between each of the neighboring apertures as measured in the vertical direction at an outer edge portion of said apertured shadow mask means is chosen to be a value within the range of 1.05 to 1.20 times the pitch between each of the neighboring apertures as measured in the vertical direction on said X-axis and the difference between said pitches at said outer edge portion and on said X-axis is proportional to the square of the distance away from said X-axis.

4. The cathode ray tube as claimed in claim 1, wherein the pitch between each of the neighboring apertures as measured in the vertical direction varies in inverse proportion to the ratio of the width of the horizontal scanning line relative to the interval between each of the neighboring horizontal scanning lines.

5. The cathode ray tube as claimed in claim 1, wherein the widths of said intervening bridges as measured in the vertical direction are constant 6. A color cathode ray tube comprising:

evacuated envelope means having a phosphor deposited screen and an electron gun assembly, positioned in opposition to said phosphor deposited screen, for emitting electron beams towards said phosphor deposited screen; and apertured shadow mask means disposed inside said evacuated envelope means generally parallel and in the vicinity spaced a predetermined distance from said phosphor deposited screen for partially blocking said electron beams from impinging upon said phosphor deposited screen, said apertured shadow mask means having a pattern of minute apertures with intervening bridge portions, the pitch between each of the neighboring apertures measured in a vertical direction perpendicular to a horizontal scanning line is increasing as a function of distance away from an X-axis parallel to the horizontal scanning line including the center of said apertured shadow mask means or of distance away from a Y-axis perpendicular to said X-axis including the center of said apertured shadow mask means, said intervening bridge portions are of constant width as measured in the vertical direction to minimize the effects of Moire patterns formed on said phosphor deposited screen.

7. The cathode ray tube a claimed in claim 6, wherein said pitch varies in proportion to the size of a shadow of an intervening bridge portion of said apertured shadow mask means which is projected on said phosphor deposited screen.

8. The cathode ray tube as claimed in claim 6, wherein said pitch between each of the neighboring apertures as measured in the vertical direction at an outer edge portion of said apertured shadow mask means in the vertical direction is chosen to be a value within the range of 1.05 to 1.20 times the pitch between each of the neighboring apertures as measured in the vertical direction on said X-axis and the difference between said pitches at said outer edge portion and on said X-axis is proportional to the square of the distance away from said X-axis.

9. The cathode ray tube as claimed in claim 6, wherein the pitch between each of the neighboring apertures as measured in the vertical direction varies in inverse proportion to the ratio of the width of the horizontal scanning line relative to the interval between each of the neighboring horizontal scanning lines.

10. A color cathode ray tube comprising:

evacuated envelope means having a phosphor deposited screen and an electron gun assembly, positioned in opposition to said phosphor deposited screen, for emitting electron beams towards said phosphor deposited screen; and apertured shadow mask means disposed inside said evacuated envelope means generally parallel and in the vicinity spaced a predetermined distance from said phosphor deposited screen for partially blocking said electron beams from impinging upon said phosphor deposited screen, said apertured shadow mask means having a pattern of minute apertures with intervening bridge portions, the pitch between each of the neighboring apertures measured in a vertical direction perpendicular to a horizontal scanning line is variable and equal to the square of the distance away from an X-axis parallel to the horizontal scanning line including the center of said apertured shadow mask means or of distance away from a Y-axis perpendicular to said X-axis and including the center of said apertured shadow mask means to minimize the effects of Moire patterns formed on said phosphor deposited screen.

11. The cathode ray tube as claimed in claim 10, wherein said pitch between each of the neighboring apertures as measured in the vertical direction at an outer edge portion of said apertured shadow mask means in the vertical direction is chosen to be a value within the range of 1.05 to 1.20 times the pitch between each of the neighboring apertures as measured in the vertical direction on said X-axis.

12. The cathode ray tube as claimed in claim 11, wherein the widths of said intervening bridge portions as measured in the vertical direction are constant.

13. A shadow mask for use in a color cathode ray tube comprising:

plural apertures, arranged and extending in rows in a vertical direction parallel to a Y-axis and perpendicular to an X-axis, which includes the center of the shadow mask, for minimizing the effects of Moire patterns on a phosphor deposited screen formed on an inner surface of the color cathode ray tube, said plural apertures formed with intervening bridge portions therebetween which are of a constant width as measured in the vertical direction, the pitch between each of the neighboring apertures is increasing as a function of the square of the distance away from the center of the shadow mask.

14. The shadow mask of claim 13 wherein the pitch between each of the neighboring apertures as measured in the vertical direction at an outer edge portion of the shadow mask is chosen to be a value within the range of 1.05 to 1.20 times the pitch between each of the neighboring apertures as measured in the vertical direction on said X-axis.

* * * * *